US007942206B2

(12) United States Patent
Huang et al.

(10) Patent No.: US 7,942,206 B2
(45) Date of Patent: May 17, 2011

(54) IN-FLOW CONTROL DEVICE UTILIZING A WATER SENSITIVE MEDIA

(75) Inventors: Tianping Huang, Spring, TX (US); James Crews, Willis, TX (US); Aaron C. Hammer, Houston, TX (US); Martin Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/191,921

(22) Filed: Aug. 14, 2008

(65) Prior Publication Data

US 2009/0095484 A1 Apr. 16, 2009

Related U.S. Application Data

(63) Continuation-in-part of application No. 11/871,685, filed on Oct. 12, 2007, and a continuation-in-part of application No. 11/875,669, filed on Oct. 19, 2007.

(51) Int. Cl.
*E21B 34/08* (2006.01)
*E21B 43/08* (2006.01)

(52) U.S. Cl. ..... 166/373; 166/319; 166/386; 166/227

(58) Field of Classification Search ..... 166/373, 166/386, 319, 227
See application file for complete search history.

(56) References Cited

U.S. PATENT DOCUMENTS 1,362,552 A 12/1920 Alexander et al.
1,649,524 A 11/1927 Hammond
1,915,867 A 6/1933 Penick
1,984,741 A 12/1934 Harrington
2,089,477 A 8/1937 Halbert
2,119,563 A 6/1938 Wells
2,214,064 A 9/1940 Niles
2,257,523 A 9/1941 Combs (Continued)

FOREIGN PATENT DOCUMENTS

CN 1385594 12/2002

(Continued)

OTHER PUBLICATIONS

Dikken, Ben J., Pressure Drop in Horizontal Wells and Its Effect on Production Performance, SPE 19824, pp. 1426-1433, 1990.

(Continued)

*Primary Examiner* — Giovanna C Wright
(74) *Attorney, Agent, or Firm* — Mossman, Kumar & Tyler, PC

(57) ABSTRACT

An apparatus for controlling fluid flow into a tubular includes an in-flow control device having a plurality of flow paths; and a reactive media disposed in each of the flow paths. The reactive media may change permeability by interacting with a selected fluid such as water. Two or more of the flow paths may be hydraulically parallel. The reactive media may include a Relative Permeability Modifier. An associated method may include conveying the fluid via a plurality of flow paths; and controlling a resistance to flow in plurality of flow paths using a reactive media disposed in each of the flow paths. An associated system may include a wellbore tubular; an in-flow control device; a hydraulic circuit formed in the in-flow control device; and a reactive media disposed in the hydraulic circuit, the reactive media may change permeability by interacting with a selected fluid.

21 Claims, 7 Drawing Sheets

U.S. PATENT DOCUMENTS 2,412,841 A 12/1946 Spangler
2,762,437 A 9/1956 Egan et al.
2,810,352 A 10/1957 Tumilson
2,814,947 A 12/1957 Stegemeier
2,942,541 A 6/1960 Huck et al.
2,942,668 A 6/1960 Maly et al.
2,945,541 A 7/1960 Maly et al.
3,326,291 A 6/1967 Zandmer
3,385,367 A 5/1968 Kollsman
3,419,089 A 12/1968 Venghiattis
3,451,477 A 6/1969 Kelley
3,675,714 A 7/1972 Thompson
3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
4,153,757 A 5/1979 Clark
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,782,896 A 11/1988 Witten
4,821,800 A 4/1989 Scott et al.
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,829,522 A 11/1998 Ross et al.
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 Den Boer
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 * 1/2003 Brockman ..... 166/250.15
6,516,888 B1 2/2003 Gunnerson et al.
6,581,681 B1 6/2003 Zimmerman et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,011,076 B1 3/2006 Weldon et al.
7,084,094 B2 8/2006 Gunn et al.
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 1/2008 Badalamenti et al.
7,325,616 B2 2/2008 Lopez de Cardenas et al.
7,395,858 B2 7/2008 Barbosa et al.
7,409,999 B2 8/2008 Henriksen et al.
7,469,743 B2 12/2008 Richards
7,673,678 B2 3/2010 MacDougall et al.
2002/0020527 A1 2/2002 Kilaas et al.
2002/0125009 A1 9/2002 Wetzel et al.
2003/0221834 A1 12/2003 Hess et al.
2004/0035578 A1 2/2004 Ross et al.
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1 * 6/2005 Russell ..... 166/229
2005/0171248 A1 8/2005 Li et al.
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado
2006/0086498 A1 4/2006 Wetzel et al.
2006/0108114 A1 5/2006 Johnson
2006/0118296 A1 6/2006 Dybevik et al.
2006/0133089 A1 6/2006 Reid
2006/0175065 A1 * 8/2006 Ross ..... 166/386
2006/0185849 A1 8/2006 Edwards et al.
2006/0272814 A1 12/2006 Broome et al.
2006/0273876 A1 12/2006 Pachla
2007/0012444 A1 * 1/2007 Horgan et al. ..... 166/278
2007/0039741 A1 2/2007 Hailey
2007/0044962 A1 3/2007 Tibbles
2007/0131434 A1 6/2007 MacDougall et al.
2007/0246210 A1 10/2007 Richards
2007/0246213 A1 10/2007 Hailey, Jr.
2007/0246225 A1 10/2007 Hailey, Jr. et al.
2007/0246407 A1 10/2007 Richards et al.
2007/0272408 A1 11/2007 Zazovsky et al.
2008/0035349 A1 * 2/2008 Richard ..... 166/308.1
2008/0035350 A1 2/2008 Henriksen et al.
2008/0053662 A1 3/2008 Williamson et al.
2008/0135249 A1 6/2008 Fripp et al.

| | | | |
|---|---|---|---|
| 2008/0149323 | A1 | 6/2008 | O'Malley et al. |
| 2008/0149351 | A1 | 6/2008 | Marya et al. |
| 2008/0236839 | A1 | 10/2008 | Oddie |
| 2008/0236843 | A1 | 10/2008 | Scott et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0133869 | A1 | 5/2009 | Clem |
| 2009/0133874 | A1 | 5/2009 | Dale |
| 2009/0139727 | A1 | 6/2009 | Tanju et al. |
| 2009/0205834 | A1 | 8/2009 | Garcia et al. |

FOREIGN PATENT DOCUMENTS

| | | | |
|---|---|---|---|
| GB | 1492345 | | 11/1977 |
| GB | 2341405 | | 12/2007 |
| JP | 59089383 | B2 | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004018833 | A1 | 3/2004 |
| WO | WO 2006/015277 | | 2/2006 |

OTHER PUBLICATIONS

Restarick, Henry, Horizontal Completion Options in REservoirs With Sand Problems, SPE 29831, pp. 545-560, 1995.

Xue, W., Hamley, I. W. and Huglin, "Rapid Swelling and Deswelling of Thermoreversible Hydrophobically Modified Poly(N-Isopropylacrylamide) Hydrogels Prepared by Freezing Polymerisation", M. B., 43(1), pp. 5181-5186, 2002.

Xue, W., Champ, S. and Huglin, "Thermoreversible Swelling Behavior of Hydrogels Based on N-Isopropylacrylamide with a Zwitterionic Comonomer", M. B., European Polymer Journal, pp. 37(5) 869-875, 2001.

Dinarvand, R., D'Emanuele, "The use of thermoresponsive hydrogels for on-off release of molecules", J. Control. Rel. 36, pp. 221-227, A 1995.

Tanaka, T., Nishio, I., Sun, S.T., Ueno-Nisho, S., "Collapse of gels in an electric field", Science, pp. 218:467-469, 1982.

Ishihara,K., Hamada, N., Sato, S., Shinohara, I., "Photoinduced serlling control of amphiphdilic azoaromatic polymer membrane". J. Polym. Sci., Polym. Chem. Ed. 22: pp. 121-128, 1984.

Ricka, J. Tanaka, T., "Swelling of Ionic gels: Quantitative performance of the Donnan Thory, Macromolecules", 17, pp. 2916-2921, 1984.

Stephen P. Mathis, Baker Oil Tools, "Sand Management: A Review of Approaches and Concerns; SPE 82240"; Presented at the SPE European Formation Damage Conference, Hague, The Netherlands 13-14; Copyright 2003, Society of Petroleum Engineers Inc, May 2003.

E. Paul Bercegeay, University of Southwestern Louisiana; Charles A. Richard, Baker Oil Tools, Inc. Member Aime; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

* cited by examiner

IN-FLOW CONTROL DEVICE UTILIZING A WATER SENSITIVE MEDIA

CROSS-REFERENCE TO RELATED APPLICATIONS

This application is a continuation-in-part from U.S. patent application Ser. No. 11/871,685 filed Oct. 12, 2007 and also a continuation-in-part of U.S. patent application Ser. No. 11/875,669 filed Oct. 19, 2007.

BACKGROUND OF THE DISCLOSURE

1. Field of the Disclosure

The disclosure relates generally to systems and methods for selective or adaptive control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it is desired to provide even drainage across a production zone and/or the ability to selectively close off or reduce in-flow within production zones experiencing an undesirable influx of water and/or gas.

The present disclosure addresses these and other needs of the prior art.

SUMMARY OF THE DISCLOSURE

In aspects, the present disclosure provides an apparatus for controlling fluid flow into a bore of a tubular in a wellbore. The apparatus may include an in-flow control device that includes a plurality of flow paths that convey the fluid from the formation into the bore of the wellbore tubular. Two or more of the flow paths may be in hydraulically parallel alignment to allow fluid to flow in a parallel fashion. A reactive media may be disposed in two or more of the flow paths. The reactive media may change permeability by interacting with a selected fluid. In embodiments, the reactive media may interact with water. In some applications, a flow path may be serially aligned with the parallel flow paths. In embodiments, the apparatus may include a flow control element in which hydraulically parallel flow paths are formed. In aspects, the reactive media may include a Relative Permeability Modifier. In embodiments, the reactive media may increase a resistance to flow as water content increases in the fluid from the formation and decrease a resistance to flow as water content decreases in the fluid from the formation. The reactive media may be formulated to change a parameter related to the flow path. Exemplary parameters include, but are not limited to permeability, tortuosity, turbulence, viscosity, and cross-sectional flow area.

In aspects, the present disclosure provides a method for controlling a flow of a fluid into a tubular in a wellbore. The method may include conveying the fluid via a plurality of flow paths from the formation into the wellbore tubular; and controlling a resistance to flow in a plurality of flow paths using a reactive media disposed in two or more of the flow paths. Two or more of the flow paths may be in hydraulically parallel alignment. In aspects, the method may also include reconfiguring the reactive media in situ.

In aspects, the present disclosure further provides a system for controlling a flow of a fluid from a subsurface formation. The system may include a wellbore tubular having a bore configured to convey the fluid from the subsurface formation to the surface; an in-flow control device positioned in the wellbore; a hydraulic circuit formed in the in-flow control device that conveys the fluid from the formation into the bore of the wellbore tubular; and a reactive media disposed in the hydraulic circuit that changes permeability by interacting with a selected fluid. The hydraulic circuit may include two or more hydraulically parallel flow paths. In aspects, the system may include a configuration tool that configures the reactive media in situ. The hydraulic circuit may include a first set of parallel flow paths in serial alignment with a second set of parallel flow paths.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
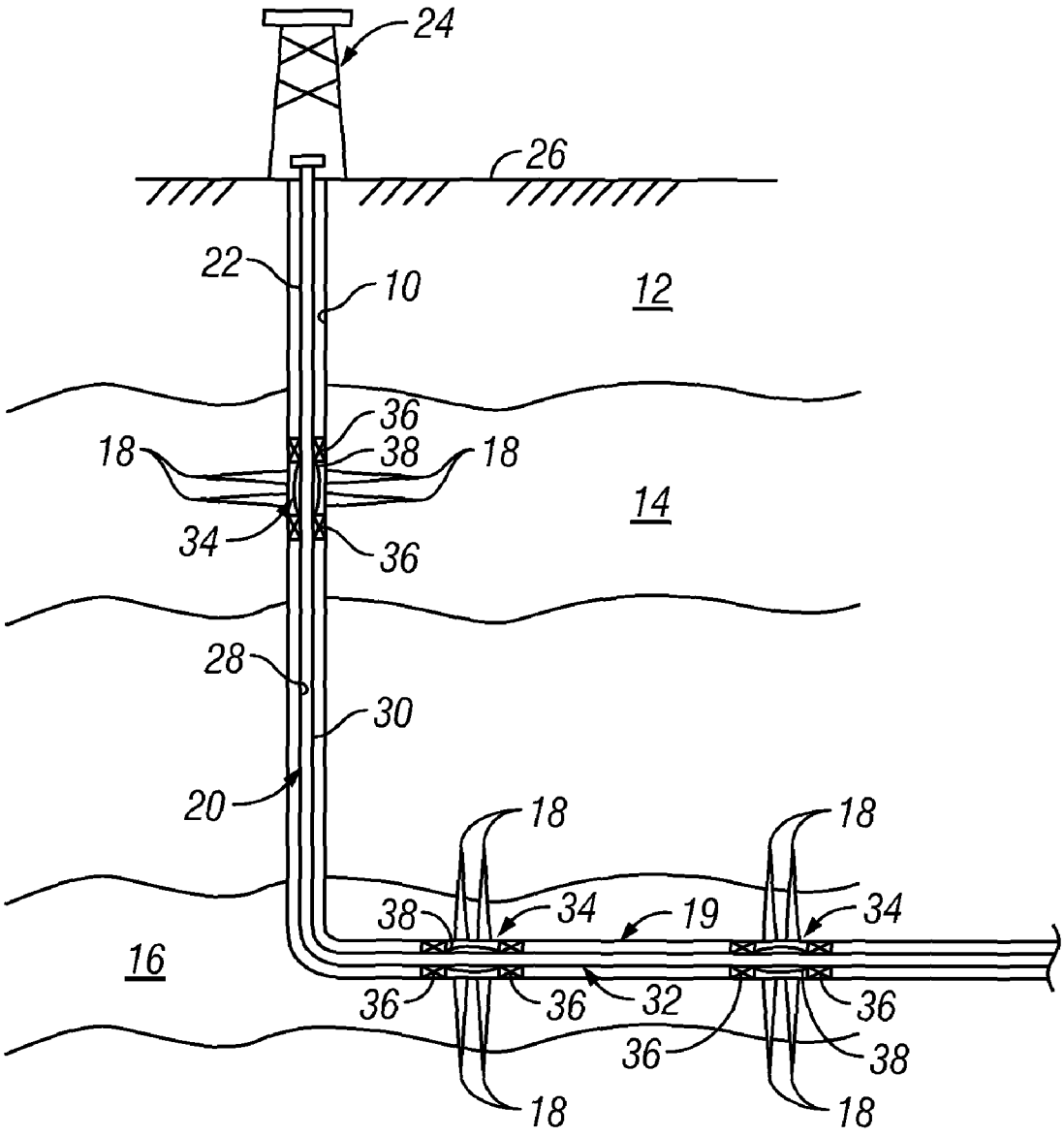
FIG. 1 is a schematic elevation view of an exemplary multi-zonal wellbore and production assembly that incorporates an in-flow control system in accordance with one embodiment of the present disclosure.

The present disclosure relates to devices and methods for controlling fluid production at a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

In embodiments, the flow of formation fluids into the wellbore tubular of an oil well may be controlled, at least in part, by using an in-flow control device that contains a media that may interact with one or more specified fluids produced from an underground formation. The interaction may be calibrated or engineered such that a flow parameter (e.g., flow rate) of the in-flowing formation fluid varies according to a predetermined relationship to a selected fluid parameter (e.g., water content, fluid velocity, gas content, etc.). The media may include a material that interacts chemically, ionically, and/or mechanically with a component of the in-flowing formation fluids in a prescribed manner. This interaction may vary a resistance to flow across the in-flow control device such that a desired value or values for a selected flow parameter such as flow rate is established for in-flow control device. While the teachings of the present disclosure may be applied to a variety of subsurface applications, for simplicity, illustrative embodiments of such in-flow control devices will be described in the context of hydrocarbon production wells.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing and cement, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
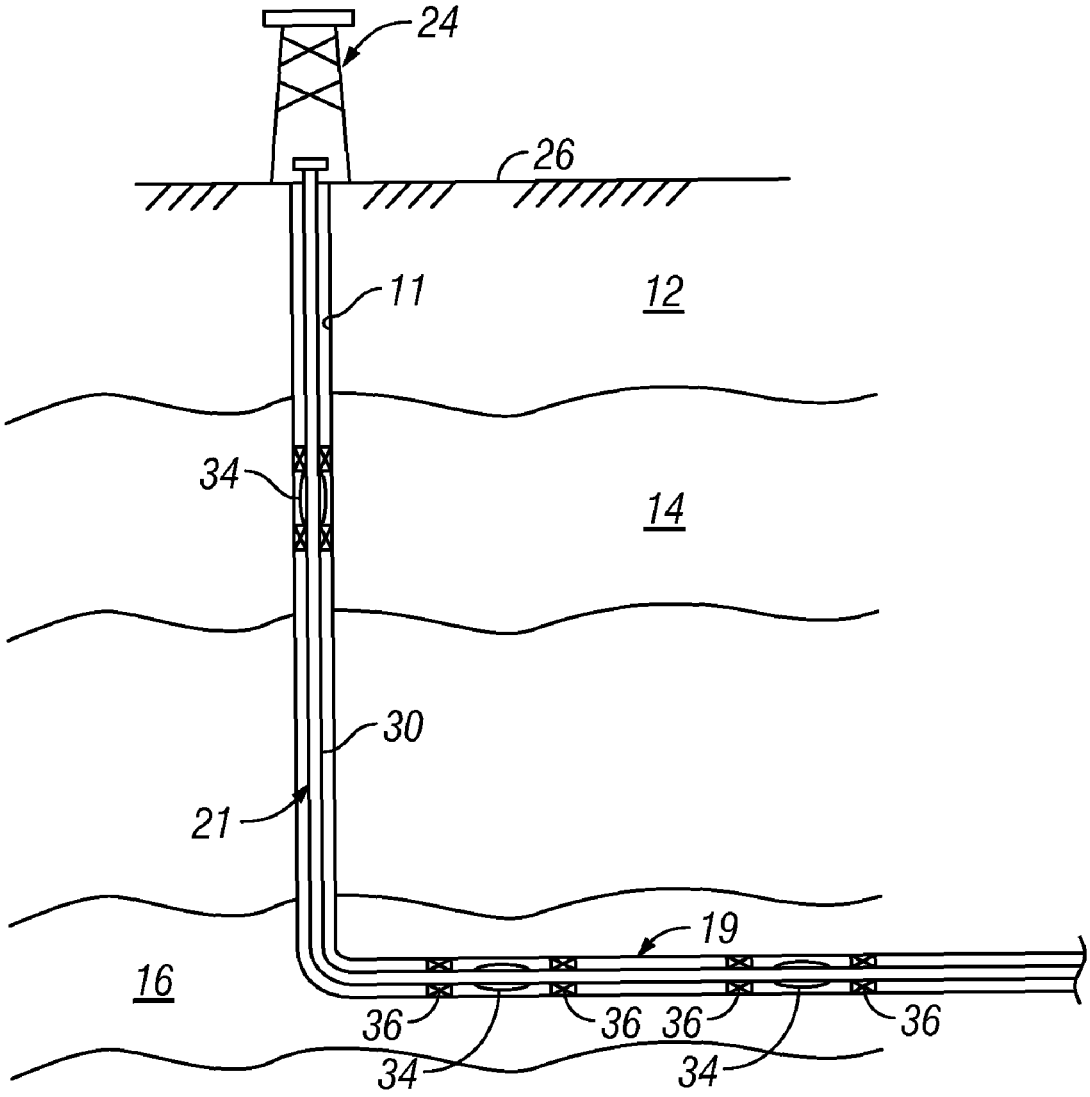
FIG. 2 is a schematic elevation view of an exemplary open hole production assembly that incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased and no cementing borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers may be omitted from the open hole completion.

Figure 3:
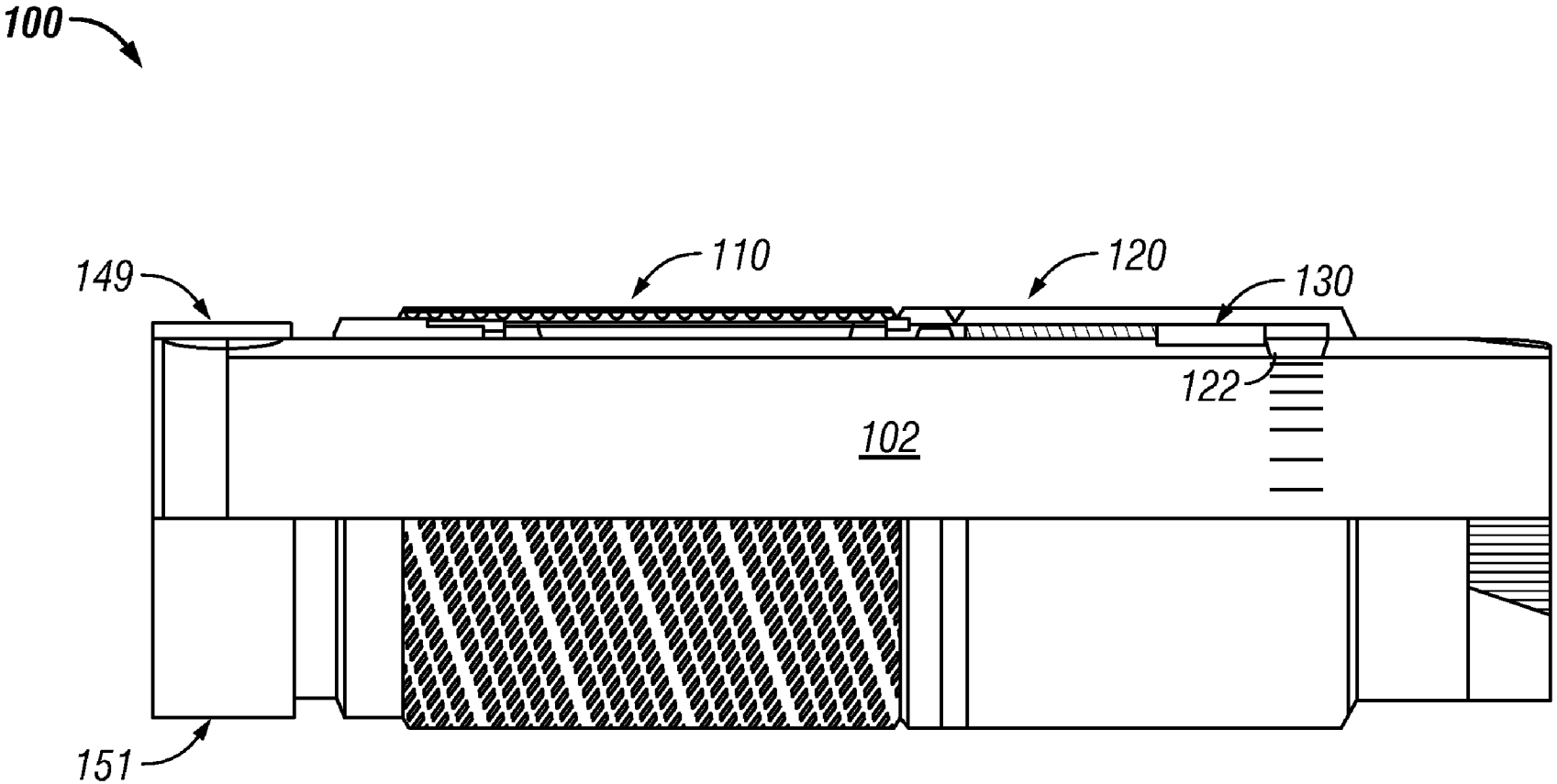
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). An opening 122 allows fluids to flow between the production control device 100 and the flow bore 102. This flow control can be a function of one or more characteristics or parameters of the formation fluid, including water content, pressure, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting in-flow of gas or water, a well owner can increase the likelihood that an oil bearing reservoir will drain efficiently. Exemplary production control devices are discussed herein below.

The production control device 100 may include one or more of the following components: a particulate control device 110 for reducing the amount and size of particulates entrained in the fluids, a flow management device 120 that controls one or more drainage parameters, and/or an in-flow control device 130 that controls flow based on the composition of the in-flowing fluid. The particulate control device 110 can include known devices such as sand screens and associated gravel packs. The in-flow control device 120 includes a plurality of flow paths between a formation and a wellbore tubular that may be configured to control one or more flow characteristics such as flow rates, pressure, etc. For example, the flow management device 120 may utilize a helical flow path to reduce a flow rate of the in-flowing fluid. While the in-flow control device 130 is shown downstream of the particulate control device 110 in FIG. 3, it should be understood that the in-flow control device 130 may be positioned anywhere along a flow path between the formation and the flow bore 102. For instance, the in-flow control device 130 may be integrated into the particulate control device 110. Furthermore, the in-flow control device may be a "stand-alone" device that may be utilized without a particulate control device 110 or flow management device 120. Illustrative embodiments are described below.

Figure 4:
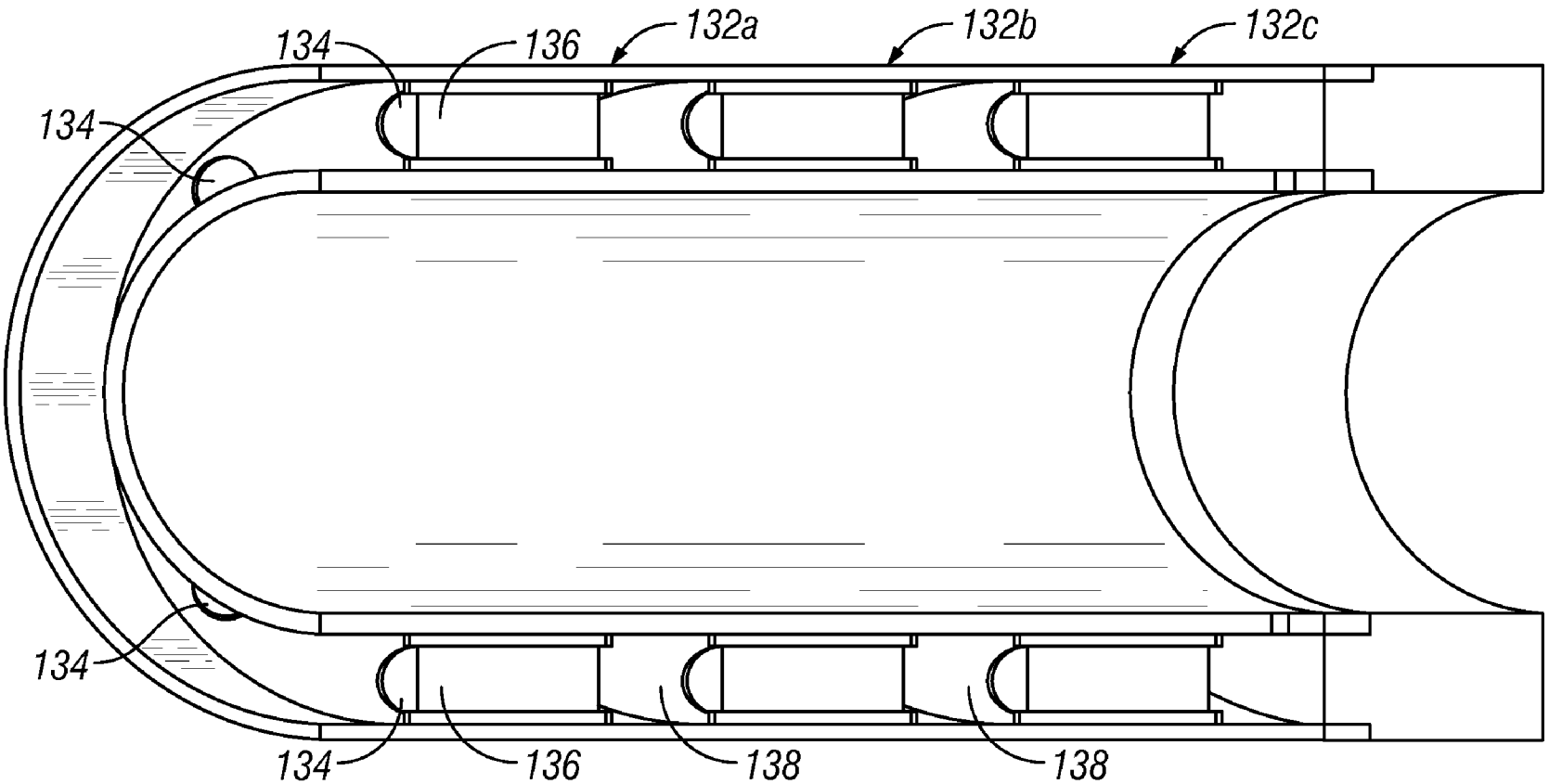
FIG. 4 schematically illustrates an exemplary in-flow control device made in accordance with one embodiment of the present disclosure.

Turning to FIG. 4, there is shown an exemplary embodiment of an in-flow control device 130. In one embodiment, the in-flow control device 130 may be configured to provide dynamic control over one or more flow parameters associated with the in-flowing fluid. By dynamic, it is meant that the in-flow control device 130 may impose a predetermined flow regime that is a function of one or more variable downhole conditions such as the amount of water in an in-flowing fluid. Exemplary flow regimes or functional responses utilized by the in-flow control device 130 are discussed below.

Figure 5:
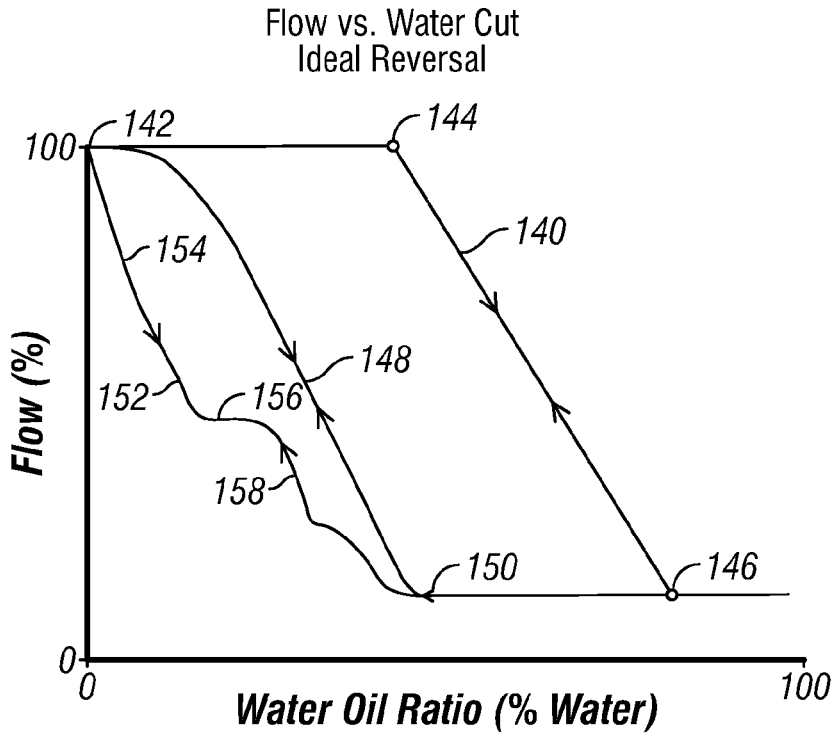
FIGS. 5 and 6 illustrate exemplary responses for in-flow control devices made in accordance with the present disclosure.

Referring now to FIG. 5, there are shown illustrative flow regimes that may be utilized by the in-flow control device 130. As shown in FIG. 5, a flow rate may be controlled in response to the amount of water, or water content, in a fluid flowing through the in-flow control device 130. In FIG. 5, the x-axis corresponds to a percentage of water in the in-flowing fluid, or "water cut," and the y-axis corresponds to a percentage of a maximum flow rate through the in-flow control device 130. The in-flow control device may be configured have a variety of different predetermined responses to water content and changes in water content in the in-flowing fluid. These responses may, in embodiments, be characterized by mathematical relationships. Additionally, the in-flow control devices 130 may control flow rates as water content both increases and decreases. That is, the flow rate control may be bi-directional/reversible and dynamic/adaptive. By dynamic/adaptive, it is meant that the in-flow control device 130 is responsive to changes in the downhole environment. Additionally, the bi-directional or reversible aspect of the in-flow control device 130 may be maintained by configuring the in-flow control device 130 to always allow a minimal amount of flow even at very high water cuts.

In a first example, the behavior of the in-flow device 130 may be characterized by line 140 wherein flow rates are held substantially constant when the in-flow is mostly water or mostly oil but varied in the intermediate region where the oil-water ratio is more balanced. The line 140 may have a first segment represented between point 142 and point 144 wherein a generally static or fixed maximum flow rate, e.g., one-hundred percent, is provided for water cut that ranges from about zero percent to perhaps fifty percent. From point 144 to point 146, flow rate varies inversely and in a linear fashion with the increase in water cut. Point 146 may roughly represent a flow rate of ten percent at a water ratio of eighty-five percent. Thereafter, the increase in water cut beyond eight-five percent does not change the flow rate. That is, the flow rate may remain at ten percent for water cut beyond eighty-five percent. The in-flow control device 130 may be configured to control flow rates in both directions along line 140.

In a second example, the behavior of the in-flow device 130 may be characterized by line 148 wherein the flow rate is varied inversely with water cut as long as the water cut remains below a threshold value. Above the threshold value, the flow rate is held substantially constant. The line 148 may have a first segment represented between point 142 and point 150. Point 142 may represent a maximum flow rate at zero percent water cut and point 150 may represent ten percent flow rate at fifty percent water cut. The line between 142 and point 150 may be approximated by a mathematical relationship wherein flow rate varies inversely and non-linearly with the increase in water cut. Thereafter, the increase in water cut beyond fifty percent does not change the flow rate. That is, the flow rate may remain at ten percent for water cut beyond fifty percent.

In a third example, the behavior of the in-flow device 130 may be characterized by line 152 wherein flow rate versus water cut is governed by a relatively complex relationship for a portion of the water cut range. The line 152 may include multiple segments 154,156,158 between points 142 and 150. Each segment 154, 156, 158 may reflect different relationships for flow rate versus water cut. The first segment 154 may utilize a steep negative slope and be linear. The second segment 156 may be a plateau-type of region wherein flow rate does not vary with changes in water cut. The third segment 158 may be a relatively non-linear region wherein the flow rate varies inversely with water cut, but not according to a smooth curve. Thereafter, the increase in water cut beyond fifty percent does not change the flow rate. That is, the flow rate may remain at ten percent for water cut beyond fifty percent.

Figure 6:
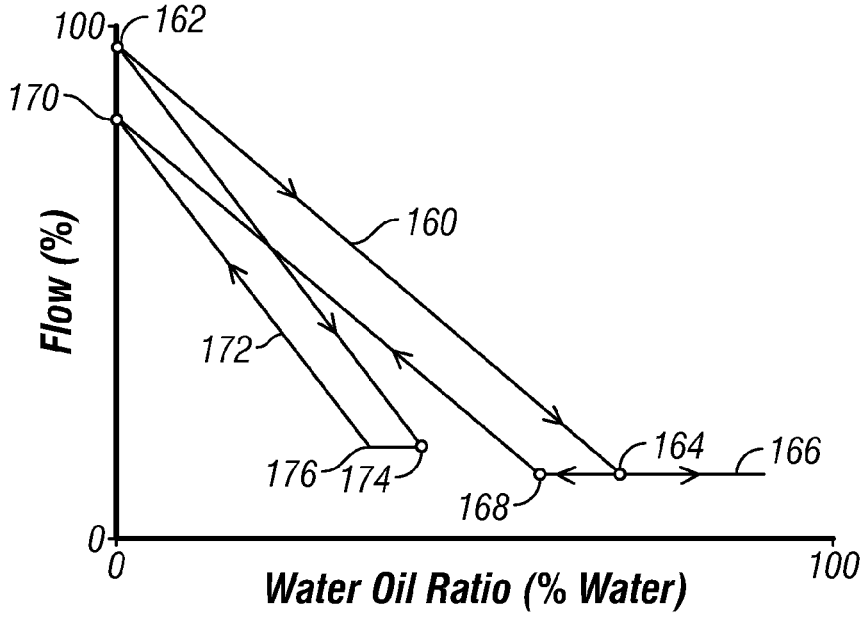

Referring now to FIG. 6, there are shown other illustrative flow regimes that may be utilized by the in-flow control device 130. In FIG. 6, the x-axis corresponds to a percentage of water in the in-flowing fluid, or "water cut," and the y-axis corresponds to a percentage of a maximum flow rate through the in-flow control device 130. The in-flow control device 130 may be configured have a relatively complex response to changes in water cut. Further, the flow rate for a given water cut may be a function of a water cut previously encountered by the in-flow control device 130. That is, while the in-flow control device 130 may be bi-directional or reversible, a first flow rate-to-water cut relationship may govern flow rates as water cut increases and a second flow rate-to-water cut relationship may govern flow rates as water cut decreases.

For example, a line 160 illustrating an asymmetric response to water cut variations may be defined by points 162, 164, 166, 168 and 170. At point 162, a maximum flow rate is provided for zero water cut. As water cut increases, the flow rate is reduced in a relatively linear manner up to point 164, which may represent a ten percent flow rate at sixty percent water cut. From point 164 to point 166, which may be ninety percent water cut or higher, the flow rate remains relatively unchanged at ten percent. As water cut decreases from some point between 164 and point 166, the in-flow control device 130 exhibits a different flow rate to water cut ratio relationship. For instance, as water cut decreases from point 166, the flow rate may remain unchanged until point 168. That is, the flow rate response may not follow a path along the line between point 164 and 162. Point 168 may represent a ten percent flow rate at fifty percent water cut. As water cut drops below fifty percent, the flow rate increases according to the line between point 168 and point 170. It should be noted that as water cut reverts to zero, the flow rate may be lower than the maximum flow rate at point 162. Thus, while the response line 160 reflects a reversible or bi-directional behavior of the in-flow control device 130, the flow rate variation associated with increasing water cut may not correspond or match the flow rate variation associated with decreasing water cut. This asymmetric behavior may be predetermined by formulating the reactive material to vary response as a function of the direction of change in water cut. In other instances, the asymmetric behavior may be due to limitations in a material's ability to fully revert to a prior shape, state, or condition. In still other instances, a time lag may occur between a time that a water cut dissipates in the in-flowing fluid and the time the water interacting with the reactive material is scoured or adequately removed from the reactive material to allow the material to return to a prior state.

Another response wherein the flow rate is dependent upon the direction of change in water cut is shown by line 172. Line 172 may be defined by points 162, 174, 176 and 170. At point 162, a maximum flow rate is provided for zero water cut. As water cut increases, the flow rate is reduced in a relatively linear manner up to point 174, which may represent a ten percent flow rate at forty percent water cut. From point 174 to point 176, the flow rate remains relatively unchanged at ten percent as water cut decreases. As water cut decreases from point 176, the flow rate increases according to the line or curve between point 176 and point 170. It should be noted that as water cut reverts to zero, the flow rate may be lower than the maximum flow rate at point 162. Thus, as before, while the response line 172 reflects a reversible or bi-directional behavior of the in-flow control device 130, the flow rate variation associated with increasing water cut may not correspond or match the flow rate variation associated with decreasing water cut.

Referring now to FIG. 4, in embodiments, the in-flow control device 130 may include one or more flow control elements 132*a,b,c* that cooperate to establish a particular flow regime or control a particular flow parameter for the in-flowing fluid. While three flow control elements are shown, it should be understood that any number may be used. Because the flow control elements 132*a,b,c* may be generally similar in nature, for convenience, reference is made only to the flow control element 132*a*. The flow control element 132*a,* which may be formed as a disk or ring, may include a circumferential array of one or more flow paths 134. The flow paths 134 provide a conduit that allows fluid to traverse or cross the body of the flow control element 132*a*. It should be appreciated that flow paths 134 provide hydraulically parallel flow across the flow control element 132*a*. Hydraulically parallel, in one aspect, refers to two or more conduits that each independently provide a fluid path to a common point or a fluid path between two common points. In another aspect, hydraulically parallel flow paths include flow paths that share two common points (e.g., an upstream point and a downstream point). By share, it is meant fluid communication or a hydraulic connection with that common point.

Thus, generally speaking, the flow paths 134 provide fluid flow across each of their associated flow control elements 132*a,b,c*. Of course, if only a single flow path 134 is present, then the flow is better characterized as a serial flow across the flow control element 132*a,b,c*.

In embodiments, each flow path 134 may be partially or completely packed or filled with a reactive permeable media 136 that controls a resistance to fluid flow in a predetermined manner. Suitable elements for containing the reactive media 136 in the flow channels include, but are not limited to, screens, sintered bead packs, fiber mesh etc. The permeable media 136 may be engineered or calibrated to interact with one or more selected fluids in the in-flowing fluid to vary or control a resistance to flow across the flow path in which the reactive media 136 resides. By calibrate or calibrated, it is meant that one or more characteristics relating to the capacity of the media 136 to interact with water or another fluid component is intentionally tuned or adjusted to occur in a predetermined manner or in response to a predetermined condition or set of conditions. In one aspect, the resistance is controlled by varying the permeability across the flow path 134.

Figure 7:
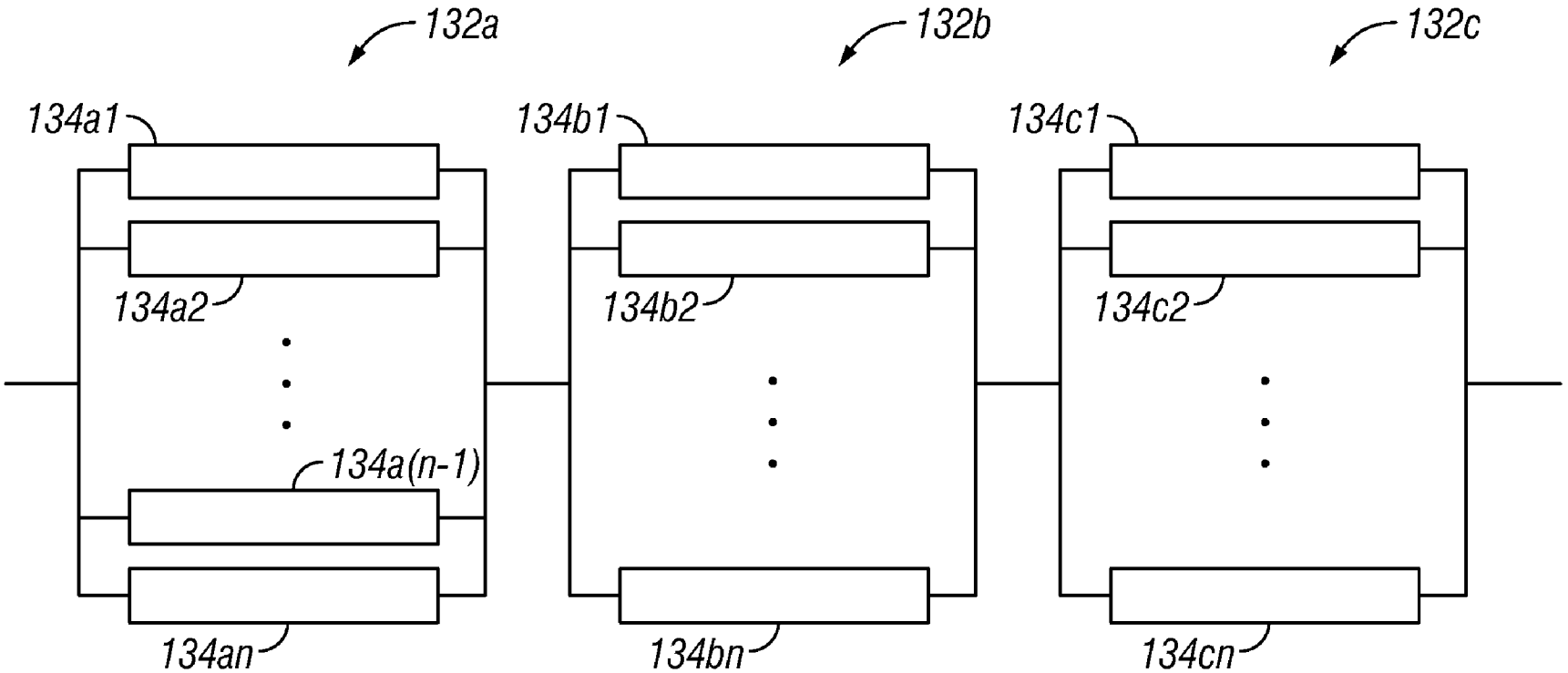
FIG. 7 schematically illustrates an exemplary arrangement for flow control elements utilized in an in-flow control device made in accordance with the present disclosure.

Referring now to FIG. 7, the flow path of the in-flowing fluid across the in-flow control device 130 is schematically illustrated as a hydraulic circuit. As shown, the flow control elements 132*a,b,c* are arranged in a serial fashion whereas the flow paths 134*a*1-*an, b*1-*bn, c*1-*cn* within each flow control element 132*a,b,c* are hydraulically parallel. In this regard, the flow paths may be considered branches making up the hydraulic circuit. For example, flow control element 132*a* includes a plurality of flow paths 134*a*1-*an,* each of which may be structurally parallel. That is, each flow path 134*a* provides a hydraulically independent conduit across the flow control element 132*a*. Each of the flow control elements 132*a,b,c* may be separated by an annular flow space 138. In an exemplary flow mode, fluid flows in a parallel fashion from a common point via at least two branches/flow paths 134 across the first flow control element 132*a*. The flow paths 134 in the first flow control element 132*a* may each present the same or different resistance to flow for that fluid and that resistance may vary depending on fluid composition, e.g., water cut. The fluid then exits at a common point and commingles in the annular space 138 separating the first flow control element 132*a* and the second flow control element 132*b*. The fluid flows in a parallel fashion across the second flow control element 132*a* and commingles in the annular space 138 separating the second flow control element 132*b* and the third flow control element 132*c*. The flow paths 134 in the second flow control element 132*b* may also each present the same or different resistance to flow for that fluid. A similar flow pattern occurs through the remaining flow control elements. It should be understood that each flow control element 132*a,b,c* as well as each annular space 138 may be individually configured to induce a change in a flow parameter or impose a particular flow parameter (e.g., pressure or flow rate). In one aspect, the hydraulic circuit may include sets of branches that are serially aligned. One or more of the set of branches may have two or more branches that are hydraulically parallel. Thus, the use of a combination of serial and parallel flow paths as well as the annular spaces extends the range and sophistication of the response of the in-flow control device 130 to changes in water cut in the in-flowing fluid.

For example, in embodiments, the reactive permeable media 136 in at least two of the flow paths 134*a*1-*an* may be formulated to react differently when exposed to a same water cut. For example, for a 15% water cut, the media in half of the flow paths 134*a*1-*an* may have a first relatively low resistance to flow (e.g., relatively high permeability) whereas the media in the other half of the flow paths 134*a*1-*an* may have a high resistance to flow (e.g., a relatively low permeability). In another example, the media in each of the flow paths 134*a*1-*an* may have a distinct and different response to particular water cut. Thus, for instance, the permeable media 136 in flow path 134*a*1 may exhibit a substantial decrease in permeability when exposed a 15% water cut and the media 136 in flow path 134*an* may exhibit a substantial decrease in permeability only when exposed to a 50% water cut. The media 136 in the intermediate flow paths, media 136*a*2-*a*(*n*-1), may each exhibit a graduated or proportionate decrease in permeability for water cut values between 15% and 50%. That is, the media in one these intermediate flow paths may exhibit an incrementally different reaction to a water cut than the media in an adjacent flow path. The flow paths in the flow elements 132*b,c* may be configured in the same manner or a different manner.

In a manner somewhat analogous to an electrical circuit, therefore, the permeability/resistance in each of the flow paths of the in-flow control device 130 as well as their relative structure (e.g., parallel and/or serial branches) may be selected to enable the in-flow control device 130 to exhibit a desired response to an applied input. Additionally, the permeability/resistance may be relative to water cut and, therefore, variable. Thus, it should be appreciated that numerous variations or permutations are available and may be utilized to achieve a predetermined flow regime or characteristic for the in-flow control device 130.

In embodiments, the reactive permeable media 136 may include a water sensitive media. One non-limiting example of a water sensitive media is a Relative Permeability Modifier (RPM). Materials that may function as a RPM are described in U.S. Pat. Nos. 6,474,413, 7,084,094, 7,159,656, and 7,395,858, which are hereby incorporated by reference for all purposes. The Relative Permeability Modifier may be a hydrophilic polymer. This polymer may be used alone or in conjunction with a substrate. In one application, the polymer may be bonded to individual particles of a substrate. Example substrate materials include sand, gravel, metal balls, ceramic particles, and inorganic particles, or any other material that is stable in a down-hole environment. The substrate may also be another polymer. To obtain a desired permeability or reactivity for a given input such as in-flowing fluid having a particular water cut, the properties of the water sensitive material may be varied by changing the polymer (type, composition, combinations, etc), the substrate (type, size, shape, combinations, etc) or the composition of the two (amount of polymer, method of bonding, configurations, etc). In one non-limiting example, when water flows in, around or through RPM modified permeable media, the hydrophilic polymers coated on the particles expand to reduce the available cross-sectional flow area for the fluid flow channel, which increases resistance to fluid flow. When oil and/or gas flow through this permeable media, the hydrophilic polymers shrink to open the flow channel for oil and/or gas flow. Additionally, a polymer may be infused through a permeable material such as a sintered metal bead pack, ceramic material, permeable natural formations, etc. In such a case, the polymer could be infused through a substrate. Additionally, a permeable foam of the polymer may be constructed from the reactive media.

In embodiments, the media may be particulated, such as a packed body of ion exchange resin beads. The beads may be formed as balls having little or no permeability. When exposed to water, the ion exchange resin may increase in size by absorbing the water. Because the beads are relatively impermeable, the cross-sectional flow area is reduced by the swelling of the ion exchange resin. Thus, flow across a flow channel may be reduced or stopped. In embodiments, the material in the flow path may be configured to operate according to HPLC (high performance liquid chromatography). The material may include one or more chemicals that may separate the constituent components of a flowing fluid (e.g., oil and water) based on factors such as dipole-dipole interactions, ionic interactions or molecule sizes. For example, as is known, an oil molecule is size-wise larger than a water molecule. Thus, the material may be configured to be penetrable by water but relatively impenetrable by oil. Such a material then would retain water. In another example, ion-exchange chromatography techniques may be used to configure the material to separate the fluid based on the charge properties of the molecules. The attraction or repulsion of the molecules by the material may be used to selectively control the flow of the components (e.g., oil or water) in a fluid.

In embodiments, the reactive media 136 may be selected or formulated to react or interact with materials other than water. For example, the reactive media 136 may react with hydrocarbons, chemical compounds, bacteria, particulates, gases, liquids, solids, additives, chemical solutions, mixtures, etc. For instance, the reactive media may be selected to increase rather than decrease permeability when exposed to hydrocarbons, which may increase a flow rate as oil content increases.

Each flow path in the in-flow control device may be specifically configured to exhibit a desired response (e.g., resistance, permeability, impedance, etc.) to fluid composition (e.g., water cut) by appropriately varying or selecting each of the above-described aspects of the media. The response of the water sensitive media may be a gradual change or a step change at a specified water cut threshold. Above the threshold the resistance may greatly increase as in a step wise fashion. As will be appreciated, any of the flow rate versus water cut relationships shown in FIGS. 5 and 6, as well as other desired relationships, may be obtained by appropriate selection of the material for the reactive media 136 and arrangement of the reactive media 136 along the in-flow control device 130.

It should be appreciated that the use of a water sensitive material within a tool deployed into a wellbore permits the water sensitive material to be calibrated, formulated and/or manufactured with a degree of precision that may not possible if the water sensitive material was injected directly into a formation. That is, the ability of applying one or more water sensitive materials to one or more permeable media substrates within one or more flow paths of a tool under controlled environmental conditions at a manufacturing facility can be done with a higher degree of precision and specifications as compared to when the water sensitive materials are pumped from the surface down casing or tubing into a subterranean formation and applied to the reservoir during downhole conditions that may not be stable or easily controlled. Additionally, because the water sensitive material-based in-flow control device is configured prior to deployment of the wellbore, the operating characteristics or behavior of such an in-flow control device may be "tuned to" or matched to an actual or predicted formation condition and/or fluid composition from a particular formation. Furthermore, in embodiments, the in-flow control device may be re-configured or adjusted in situ.

Figure 8:
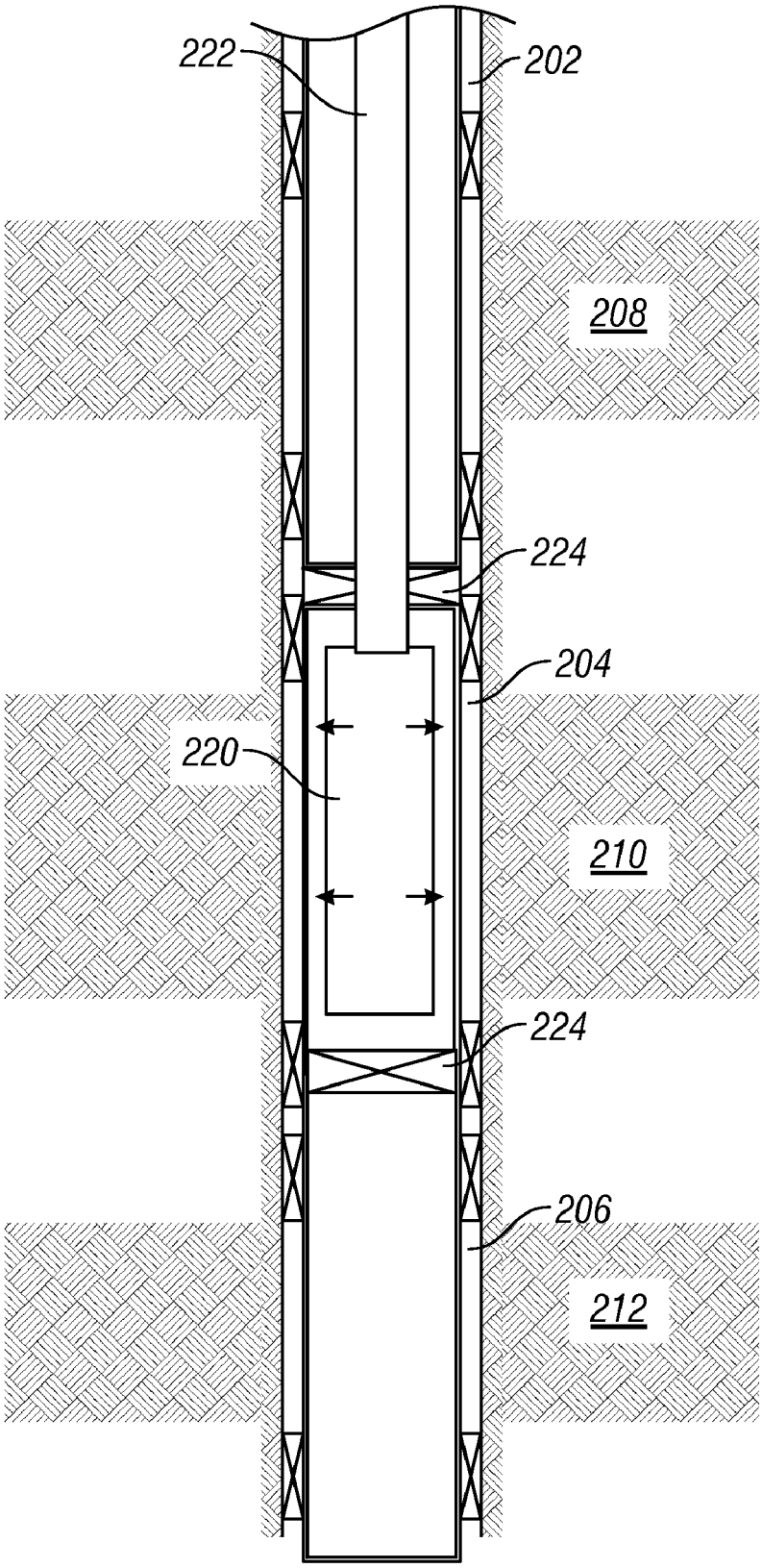
FIG. 8 schematically illustrates a subsurface production device utilizing in-flow control devices made in accordance with the present disclosure and an illustrative configuration device for configuring such in-flow control devices.

Referring now to FIG. 8, there is shown a production well 200 having production control devices 202, 204, 206 that control in-flow of formation fluids from reservoirs 208, 210, 212, respectively. While the production control devices 202, 204, 206 are shown relatively close to one another, it should be understood that these devices may be separated by hundreds of feet or more. The production control devices 202, 204, 206 may each include water sensitive material to control one or more flow parameters of in-flowing fluid as described above. Advantageously, embodiments of the present disclosure provide the flexibility to configure, re-configure, replenish, dewater or otherwise adjust one or more characteristics of the production control devices 202, 204, 206. Moreover, each of the production control devices 202, 204, 206 may be independently adjusted in situ.

Furthermore, referring to FIG. 8, the production control devices 202, 204, 206 that control in-flow of formation fluids may each include a hydrophobic material on the permeable media substrate to control one or more flow parameters of in-flowing fluid as described above. For example, use of hydrophobic material coated permeable media substrate in one or more flow paths can be of utility for optimizing a tool's sensitivity to select water/oil ratios, such as at higher water/oil ratios. Another non-limiting example may be for wells having higher flow rates with select water/oil ratios. Still another non-limiting example can be for select flow path and permeable media substrate sizing configurations.

In one embodiment, a configuration tool 220 may be conveyed via a conveyance device 222 into the well 200. Seals 224 associated with the configuration tool 220 may be activated to isolate the configuration tool 220 and the production control device 204 from production control devices 202 and 206. This isolation ensures that fluids or other materials supplied by the configuration tool 220 may be transmitted to affect only the production control device 204. Thereafter, the conveyance device 222 may be operated to configure the production control device 204. For example, the configuration tool 220 may inject an additive, a slurry, an acid or other material that reacts with the WSM in the production control device 204 in a prescribed manner. The fluid may be pumped from the surface via the conveyance device 220, which may be coiled tubing or drill string. The fluid may also be injected using a bailer configured to receive a pressurized fluid from a pump (not shown). Referring now to FIGS. 3 and 8, the fluid supplied by the conveyance device 220 may flow from the flow bore 102 into the production control device 204/100 via the openings 122. Other modes for configuring or reconfiguring the production control device 204 may include applying energy (e.g., thermal, chemical, acoustical, etc.) using the configuration device 220 and mechanically scouring or cleaning the production control device 204 using a fluid, i.e., a mechanical as opposed to chemical interaction.

In illustrative operating modes, the configuration tool 220 may inject a fluid that dewaters the water sensitive material in the production control device 204 to thereby reestablish in-flow across the production control device 204. In another application, the configuration tool 220 may inject a material that or decreases the reactivity of the water sensitive material. For instance, the injected material may transform a water sensitive material that has a 50% water cut threshold to a water sensitive material that has a 30% or 80% water cut threshold. Also, the injected material may replace a first water sensitive material with a second different water sensitive material. Further, in one scenario, analysis of formation fluids from the reservoir 210 may be utilized to configure the production control device 204 at the surface. Thereafter, the production control device 204 may be conveyed into and installed in the well 200 adjacent to the reservoir 210. Some time thereafter, an analysis of the fluid from reservoir 201 may indicate that a change in one or more characteristics of the production control device 204 may yield a more desirable in-flow rate, which may be higher or lower. Thus, the configuration device 220 may be conveyed into the well 200 and operated to make the desired changes to the production control device 204. In another scenario, the production control device 204 may utilize a water sensitive material that degrades in effectively after some time period. The configuration device 220 may be deployed periodically into the well 220 to refurbish the production control device 204.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other well bore tubulars.

Thus, what has been described includes, in part, an apparatus for controlling a flow of a fluid between a bore of a tubular in a wellbore. The apparatus may include an in-flow control device that includes a plurality of flow paths, two or more of which may be hydraulically parallel, that conveys the fluid from the formation into a flow bore of the wellbore tubular. A reactive media may be disposed in each of the flow paths. The reactive media may change permeability by interacting with a selected fluid, e.g., water. In some applications, at least two of the flow paths in the in-flow control device may be in a serial arrangement. In embodiments, the reactive media may include a Relative Permeability Modifier. In one non-limiting arrangement, the reactive media may increase a resistance to flow as water content increases in the fluid from the formation and decrease a resistance to flow as water content decreases in the fluid from the formation. The reactive media may be formulated to change a flow parameter such as permeability, tortuosity, turbulence, viscosity, and cross-sectional flow area.

What has been described includes, in part, a method for controlling a flow of a fluid into a tubular in a wellbore. The method may include conveying the fluid via a plurality of flow paths from the formation into a flow bore of the wellbore tubular; and controlling a resistance to flow in plurality of flow paths using a reactive media disposed in each of the flow paths. Two or more of the flow paths may be hydraulically parallel. In aspects, the method may also include reconfiguring the reactive media in situ.

What has been described includes, in part, a system for controlling a flow of a fluid from a subsurface formation. The system may include a wellbore tubular having a bore that conveys the fluid from the subsurface formation to the surface; an in-flow control device positioned in the wellbore; a hydraulic circuit formed in the in-flow control device that conveys the fluid from the formation into the bore of the wellbore tubular; and a reactive media disposed in the hydraulic circuit that changes permeability by interacting with a selected fluid. The hydraulic circuit may include two or more hydraulically parallel flow paths. In aspects, the system may include a configuration tool that configures the reactive media in situ. The hydraulic circuit may include a first set of parallel flow paths in serial alignment with a second set of parallel flow paths.

Referring now to FIG. 3, it should be appreciated that the reactive media may be positioned in places other than the in-flow control device 130. For example, the flow path 310 may be within the particulate control device 110, along the channels of the flow management device 120, or elsewhere along the production control device 100. The reactive media used in such locations may be any of those described previously or described below.

For the sake of clarity and brevity, descriptions of most threaded connections between tubular elements, elastomeric seals, such as o-rings, and other well-understood techniques are omitted in the above description. Further, terms such as "slot," "passages," "conduit," "opening," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid into a bore of a wellbore tubular, comprising:

a plurality of flow paths configured to convey the fluid from the formation into the bore of the wellbore tubular, the flow paths being formed between a particulate control device and an opening in the wellbore tubular and wherein at least two of the flow paths are hydraulically parallel; and a reactive media disposed in at least two flow paths of the plurality of flow paths, each reactive media being configured to change permeability in an associated flow path by interacting with a selected fluid.

2. The apparatus of claim 1 wherein the selected fluid is water.

3. The apparatus of claim 1 wherein at least one flow path of the plurality of flow paths is serially aligned with the at least two hydraulically parallel flow paths.

4. The apparatus of claim 1 further comprising a housing receiving a flow control element, wherein the at least two hydraulically parallel flow paths are formed in the flow control element.

5. The apparatus of claim 1 wherein the reactive media includes a Relative Permeability Modifier.

6. The apparatus of claim 1 wherein the reactive media increases a resistance to flow as water content increases in the fluid from the formation and decreases a resistance to flow as water content decreases in the fluid from the formation.

7. The apparatus of claim 1 wherein the reactive media changes a parameter related to the flow path, the parameter being selected from a group consisting of: (i) permeability, (ii) tortuosity, (iii) turbulence, (iv) viscosity, and (v) cross-sectional flow area.

8. The apparatus of claim 1 further comprising an in-flow control device, wherein the plurality of flow paths are formed in the in-flow control device.

9. A method for controlling a flow of a fluid into a tubular in a wellbore, comprising:

conveying the fluid via a plurality of flow paths from the formation into the wellbore tubular, the flow paths being formed between a particulate control device and an opening in the wellbore tubular and wherein at least two of the flow paths are hydraulically parallel; and controlling a resistance to flow across the plurality of flow paths using a reactive media disposed in at least two flow paths of the plurality of flow paths.

10. The method of claim 9 wherein the selected fluid is water.

11. The method of claim 9 further comprising conveying the fluid via at least one flow path that is serially aligned with the at least two hydraulically parallel flow paths.

12. The method of claim 9 further comprising forming the at least two hydraulically parallel flow paths in a flow control element.

13. The method of claim 9 wherein the reactive media includes a Relative Permeability Modifier.

14. The method of claim 9 wherein the reactive media increases a resistance to flow as water content increases in the fluid from the formation and decreases a resistance to flow as water content decreases in the fluid from the formation.

15. The method of claim 9 wherein the reactive media changes a parameter related to the flow path, the parameter being selected from a group consisting of: (i) permeability, (ii) tortuosity, (iii) turbulence, (iv) viscosity, and (v) cross-sectional flow area.

16. The method of claim 9 further comprising reconfiguring the reactive media in situ.

17. A system for controlling a flow of a fluid from a subsurface formation, comprising:

a wellbore tubular having a bore configured to convey the fluid from the subsurface formation to the surface;

an in-flow control device positioned in the wellbore and along the wellbore tubular;

a hydraulic circuit formed in the in-flow control device, the hydraulic circuit being configured to convey the fluid from the formation into the bore of the wellbore tubular, wherein the hydraulic circuit includes at least two hydraulically parallel flow paths, the flow paths being formed between a particulate control device and an opening in the wellbore tubular; and a reactive media disposed in each of the at least two flow paths the hydraulic circuit, each reactive media being configured to change permeability in an associated flow path by interacting with a selected fluid.

18. The system of claim 17 further comprising a configuration tool adapted to be conveyed into the wellbore and configure the reactive media in situ.

19. The system of claim 17 wherein the hydraulic circuit includes at least one flow path that is serially aligned with the at least two hydraulically parallel flow paths.

20. The system of claim 17 wherein the reactive media includes a Relative Permeability Modifier.

21. The system of claim 17 wherein the reactive media increases a resistance to flow as water content increases in the fluid from the formation and decreases a resistance to flow as water content decreases in the fluid from the formation.

* * * * *